US006592719B1

(12) United States Patent
Porter

(10) Patent No.: US 6,592,719 B1
(45) Date of Patent: Jul. 15, 2003

(54) SHOE PRESS HEAD INDEXING SYSTEM

(75) Inventor: Mark Anthony Porter, Lancashire (GB)

(73) Assignee: Sandusky Walmsley Limited, Lancashire (GB)

( * ) Notice: Subject to any disclaimer, the term of this patent is extended or adjusted under 35 U.S.C. 154(b) by 0 days.

(21) Appl. No.: 10/252,246

(22) Filed: Sep. 23, 2002

(30) Foreign Application Priority Data

Mar. 22, 2002 (GB) ..... 0206728

(51) Int. Cl.[7] ..... D21F 3/08

(52) U.S. Cl. ..... 162/199; 162/272; 162/358.3; 162/358.4

(58) Field of Search ..... 162/199, 205, 162/272, 358.3, 358.4

(56) References Cited

U.S. PATENT DOCUMENTS 4,707,222 A * 11/1987 Mullner et al. ..... 162/358.3
5,643,416 A 7/1997 Lange et al.
5,733,415 A 3/1998 Breiten
5,775,564 A 7/1998 Ilmarinen
5,900,118 A 5/1999 Breiten

FOREIGN PATENT DOCUMENTS

WO WO 97/46756 5/1997
WO WO 98/19004 10/1997

* cited by examiner

*Primary Examiner*—Karen M. Hastings
(74) *Attorney, Agent, or Firm*—Emch, Schaffer, Schaub & Porcello Co., L.P.A.

(57) ABSTRACT

A shoe press head indexing system wherein axial tension is applied to a blanket in a shoe press of a papermaking machine by means of respective fluid actuated piston and cylinder assemblies which are mounted inside the blanket and apply axial pressure to the first and second heads between which the blanket is mounted. Neither head is fixed or limited in position at any time. The respective fluid assemblies include respective displacement sensors whereby the positions of the heads, and thereby of the blanket, relative to the press can be determined and monitored. Automatic adjustments can then be made to the pressure in the assemblies and hence to the positions of the heads to maintain the blanket in substantially central position on the press.

2 Claims, 1 Drawing Sheet

SHOE PRESS HEAD INDEXING SYSTEM

BACKGROUND OF THE INVENTION

This invention concerns a system for applying axial tension to a blanket in a shoe press of a papermaking machine.

In a shoe press, an elongate shoe having a concave surface forms a nip with a backing roll. This lengthens the duration of contact with a paper web passing through the nip to allow more water to pass from the web into one or more supporting felts, as required in modern high speed presses where the paper web may be traveling at something in the order of 15 m/sec.

In order for the paper web to move through the nip without frictional resistance, a blanket in the form of a seamless tube is passed over the shoe. The blanket is lubricated and cooled by a supply of oil or other lubricant which is forced between the blanket and the shoe. To prevent leakage of lubricant, which could contaminate the paper web and surrounding equipment, the blanket is sealed at each end to a respective head. The heads, referred to as front and back heads, each have an outer portion (termed an outer head) which is circular and is mounted rotation on a journal of a support beam, which also supports the shoe and a hydraulic piston which urges the shoe towards the backing roll.

As the blanket is caused to move through the nip, by virtue of frictional engagement with the paper web, any supporting felt, and the backing roll, it assumes a dimpled shape (rather like an apple) in cross section in conformity with the concave shoe. However, the blanket extends beyond each end of the shoe to attach to the circular outer heads. The transition from the dimpled shape to the circular shape means that in the region adjacent each end the blanket undergoes repeated changes in curvature, resulting in wear and eventual failure. This can be a significant source of maintenance down time and contributor to the cost of the papermaking process.

The motion of the blanket through the nip also results in gradual lengthening of the blanket in the cross machine direction owing to its continual compression. In this respect, over a period of about 6 months, it can stretch or lengthen by something of order of 15 to 20 cm. To some extent this can be accommodated by a indexing system comprising hydraulic piston and cylinder assemblies which are mounted between the support beam and each head to apply tension to the heads. Periodically, however, the blanket has to be trimmed, which involves releasing it from the heads and refixing. This may result in 6 to 8 hours downtime.

The indexing system serves the further purpose, of course, of keeping the blanket shape stable as it rotates during operation of the press, preventing creasing and twisting as it passes through the nip.

Hitherto, as described in U.S. Pat. Nos. 5,775,564, 5,643,416, 5,733,415, and 5,900,118, the position of one head, attached to the end of the blanket, has been fixed, by specific locking, by control of the position of its hydraulic cylinders, or by abutment against stop means, whilst the other head, attached to the other end of the blanket, is allowed to float. It may be held under substantially constant tension by means of a hydraulic cylinder, but its position is not fixed, so it can move axially to take up slack as the blanket stretches or lengthens. Periodically, the hydraulic systems attached to the front and back heads are reversed, so the floating head then becomes fixed and the formerly fixed head floats. This changeover may take place every few days or weeks. The wear at the fixed end is always greater than that at floating end because the region of the blanket subject to wear tends not to move so much at the fixed end.

SUMMARY OF THE INVENTION

The invention provides a method of applying axial tension to a blanket in a shoe press of a papermaking machine which is characterized in that both heads are permanently floating and axial pressure applied thereto is controlled such that the blanket maintains a substantially central position on the press and elongation of the blanket during operation of the press is taken up substantially equally by the first and second heads. Thus, neither head is fixed in position at any time.

Furthermore, the apparatus of the shoe press includes respective fluid actuated piston and cylinder assemblies mounted inside the blanket and operative to apply axial pressure to the first and second heads, thereby to tension the blanket, characterized in that the respective fluid assemblies include respective displacement sensors whereby the positions of the heads, and thereby of the blanket, relative to the press can be determined and monitored, and in that means are provided whereby automatic adjustments are then made to the positions of the heads to maintain the blanket in a substantially central position on the press. The heads are limited in travel by the stroke of their respective cylinders. No other mechanical means of limiting the travel of the heads needs to be provided.

An object of the invention is to provide an improved system of head indexing in a shoe press of the type described above, whereby the life of the blanket may be increased.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
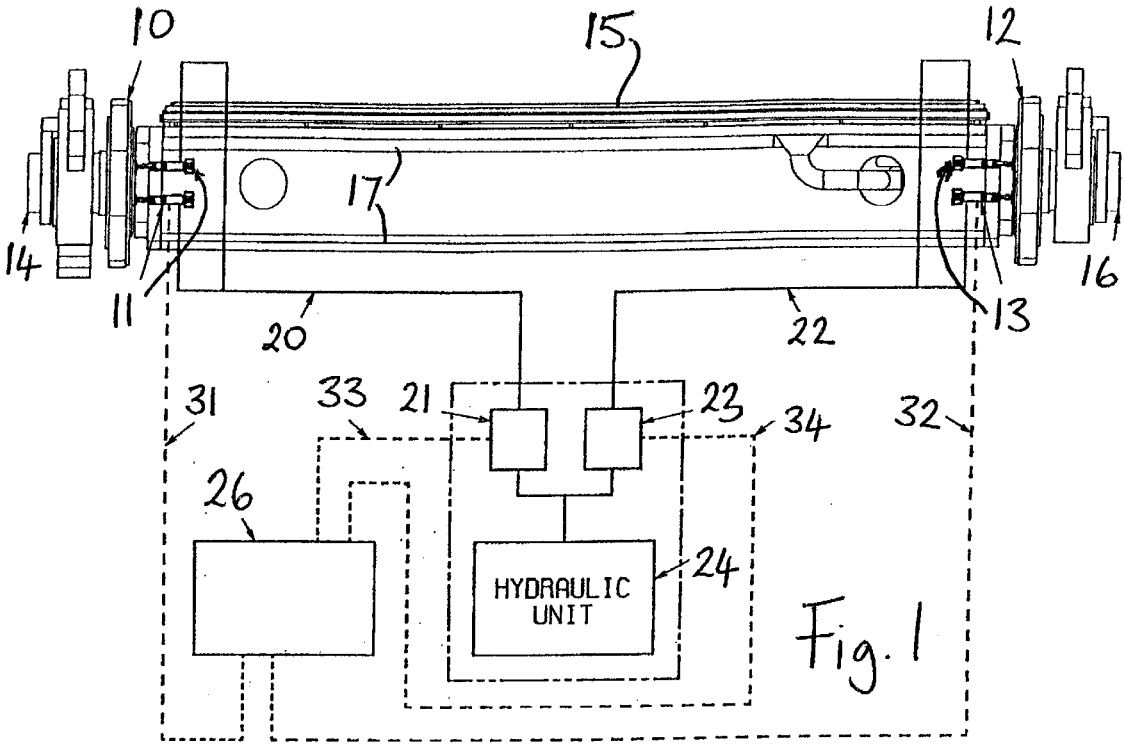
FIG. 1 is a schematic front elevational view of a shoe press of a papermaking machine with the blanket removed for clarity together with diagrammatic representation of the hydraulic and control system.
Figure 2:
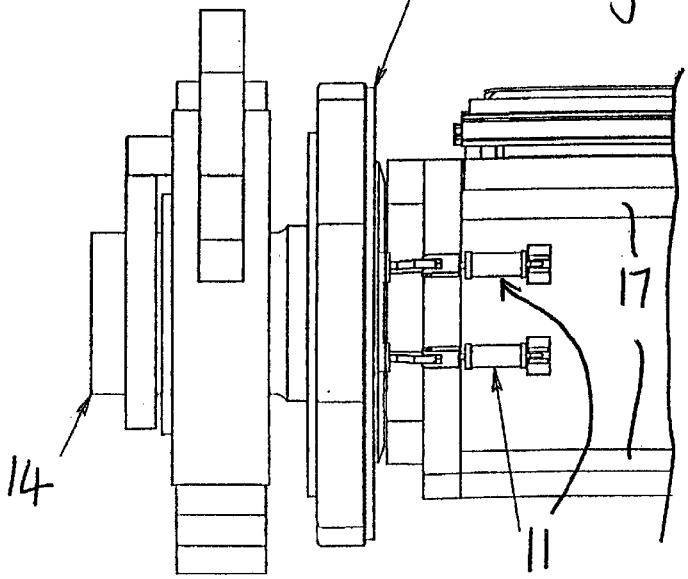
FIG. 2 is an enlarged view of the left hand end of FIG. 1.

With reference to FIGS. 1 and 2, front and back heads 10, 12 are mounted onto press journals 14,16 in such a way as to allow them to slide along the axis of the press approximately 10 cm each. Hydraulic cylinders 11, 13 are mounted to the heads 10, 12 to control axial movement of the of the heads. In this respect, the cylinders 11, 13 are mounted by way of brackets onto a central support beam 17 for an elongate shoe 15 having a concave surface. As mentioned, the blanket which encircles the shoe 15 and its support beam and is, in use, sealingly clamped between the respective heads 10,12 is not shown for the sake of clarity.

The cylinders 11, 13 are enclosed within the blanket, but are supplied with fluid via lines 20, 22 which are shown schematically in FIG. 1, but in practice they would extend through the heads 10, 12. These lines 20, 22 connect via respective proportional control valves 21, 23, to a common hydraulic unit 24.

The cylinders 11, 13 are fitted with integral electronic displacement transducers which enable the exact extension of their respective pistons to be measured by the electronic control system 26 of the machine. In this respect, the machine control system 26 is shown schematically in FIG. 1 along with electrical connections therefrom 31,32 to transducers and 33,34 to the proportional control valves 21, 23.

During operation of the shoe press, tension will be applied by both sets of cylinders 11,13 simultaneously, with fluid pressure to each cylinder being controlled by the machine control system 26 to maintain a substantially constant predetermined tension on the blanket. Both heads 10, 12 will be permanently floating (i.e., not fixed in position by any external mechanical means) and the stretch of the blanket will be taken up equally at the front and back heads 10, 12. The axial displacement of the respective heads 10,12 will be limited only by the stroke of the respective cylinder pistons, which will be similar to the maximum possible sliding adjustment of the heads (i.e., about 10 cm each, as mentioned).

By virtue of the displacement transducers in the cylinders 11,13 the machine control system 26 will, by way of connections 31, 32, continuously monitor the amount of extension of the blanket at the front and back side of the press. With this information it is possible to determine the position of the blanket relative to the press by a simple calculation within the machine control system 26. Once the position of the blanket is known to the control system, the system can automatically adjust pressure, via signals to the control valves 21, 23, to either the front or back cylinders 11, 13 to move the blanket in an axial direction to centralize it in relation to the press. In this way, it is possible in accordance with the invention to maintain the center line of the blanket in line with the center line of the press. It is not intended to force any oscillation of the blanket in the axial direction. However the nature of this system will result in a small oscillation as the system tries to maintain the blanket position.

The foregoing is illustrative, not limitative of the scope of the invention and variations in detail are possible.

I claim:

1. A shoe press for a papermaking machine comprising a backing roll and a shoe with a concave surface urged against the backing roll to provide extended nip, and a blanket extending as a closed loop through the nip, and moving relative to the shoe in the machine direction, the blanket having first and second ends secure to first and second heads, which are rotatably mounted to a press frame such that both heads are permanently floating, and respective fluid actuated piston and cylinder assemblies mounted inside the blanket and operative to apply axial pressure to the first and second heads, thereby to tension the blanket, in that the respective fluid assemblies include respective displacement sensors whereby the positions of the heads, and thereby of the blanket, relative to the press can be determined and monitored, and in that means are provided whereby automatic adjustments are then made to the positions of the heads to maintain the blanket in a substantially central position on the press.

2. A method of applying axial tension to a blanket in a shoe press for a papermaking machine, the shoe press having a backing roll and a shoe with a concave surface urged against the backing roll to provide an extended nip, and the blanket extending as a closed loop through the nip, and moving relative to the shoe in the machine direction, the blanket having first and second ends secure to first and second heads, which are rotatably mounted in that both heads are permanently floating and axial pressure applied thereto is controlled such that the blanket maintains a substantially central position on the press and elongation of the blanket during operation of the press is taken up substantially equally by the first and second heads.

* * * * *